US005787770A

United States Patent [19]

Shimada et al.

[11] Patent Number: 5,787,770

[45] Date of Patent: Aug. 4, 1998

[54] ROTATIONAL ACTUATOR

[75] Inventors: Kyomi Shimada, Toyota; Nuio Tsuchida, Nagoya, both of Japan

[73] Assignee: Toyota Jidosha Kabushiki Kaisha, Aichi-Ken, Japan

[21] Appl. No.: 684,847

[22] Filed: Jul. 25, 1996

[30] Foreign Application Priority Data

Aug. 7, 1995 [JP] Japan ..... 7-200959

[51] Int. Cl.[6] ..... B25B 13/00; B25B 21/00

[52] U.S. Cl. ..... 81/54; 81/467; 81/52; 81/57.39; 81/465

[58] Field of Search ..... 81/54, 52, 467, 81/57.39, 463, 465

[56] References Cited

U.S. PATENT DOCUMENTS

| | | | |
|---|---|---|---|
| 2,263,709 | 11/1941 | Sittert | 81/54 |
| 2,600,327 | 6/1952 | Ridge | 81/54 |
| 3,494,592 | 2/1970 | Meschonat et al. | 81/54 |
| 4,418,768 | 12/1983 | Swenson | 81/54 |
| 4,585,078 | 4/1986 | Alexandrov et al. | 81/465 |
| 4,813,312 | 3/1989 | Wilhelm | 81/467 |
| 5,076,120 | 12/1991 | Lin | 81/54 |
| 5,509,330 | 4/1996 | Nick | 81/54 |

FOREIGN PATENT DOCUMENTS

| | | | |
|---|---|---|---|
| A-0160707 | 11/1985 | European Pat. Off. . | |
| 1503043 | 10/1969 | Germany | 81/54 |
| 1939262 | 12/1982 | Germany | 81/54 |
| A-61-88771 | 5/1986 | Japan . | |
| A-63-11074 | 1/1988 | Japan . | |

OTHER PUBLICATIONS

IBM Technical Disclosure Bulletin, vol. 30, No. 8, Jan. 1988, "Piezoelectric Rotator and Micropositioner", pp. 56–57.

*Primary Examiner*—James G. Smith
*Assistant Examiner*—Lee Wilson
*Attorney, Agent, or Firm*—Oliff & Berridge, PLC

[57] ABSTRACT

A rotational actuator includes an actuator case, a first rotor supported on the actuator case for rotation about an axis of rotation, a second rotor supported on the actuator case coaxially with the first rotor and for rotation independent of the first rotor, an expandable member having one end secured to the second rotor and the other end secured to the first rotor for relatively rotating the first and second rotors by expansion or contraction thereof, and an expandable member controller for controlling the extent of expansion and contraction of the expandable member. The momentum of the first rotor in the rotational direction thereof when the expandable member is expanded or contracted is set to be higher than the momentum of the second rotor in the rotational direction thereof at this time.

14 Claims, 5 Drawing Sheets

ROTATIONAL ACTUATOR

BACKGROUND OF THE INVENTION

1. Field of the Invention

This invention relates to a rotational actuator and a screwing rotational actuator and, more particularly, to a technique of reducing energy loss, vibrations, noises and reactions.

2. Description of the Prior Art

A usual handy screwing machine of impact type, as shown in FIG. 5(A), comprises a drive part 2 and an impact part 4. The drive part 2 generates rotational force and is suitably a pneumatic rotational actuator 2*a*. The impact part 4 converts the torque of the rotational actuator 2*a* to an impact force and transmits this force to an output shaft 6. This impact part 4 is usually of a hammer ring type, as shown in FIGS. 5(B) and 5(C).

The impact part 4 includes a cylindrical member 2*t* positioned coaxially around the output shaft 6. A rotational shaft 2*r* of the rotational actuator 2*a* is coupled to the cylindrical member 2*t*. Inside the cylindrical member 2*t*, a hammer cam 2*k* is mounted. When the cylindrical member 2*t* is rotated relatively to the output shaft 6, an end portion of the hammer cam 2*k* tangentially strikes an impact face 6*u* of the output shaft 6.

When the hammer cam 2*k* strikes the impact face 6*u* of the output shaft 6, the output shaft 6 receives kinetic energy of the hammer cam 2*k* and is rotated in the direction of rotation of the hammer cam 2*k*. Meanwhile, the hammer cam 2*k* is tentatively stopped due to rebounding, thus tentatively stopping the cylindrical member 2*t* with the hammer cam 2*k* coupled thereto and also the rotational actuator 2*a*. As a result, the flow of air supplied to the rotational actuator 2 is blocked, thus increasing the inner pressure in the rotational actuator 2. By the increased air pressure, the rotational actuator 2 is driven to rotate the cylindrical member 2*t* and the hammer cam 2*k*. The hammer cam 2*k* thus strikes the impact face 6*u* of the output shaft 6 again. By repeating this operation, the output shaft 6 is rotated intermittently by the impact force of the hammer cam 2*k* to apply screwing force to a screw w. It is also well-known to use a drive motor as the drive part 2. The hammer cam 2*k* may have various well-known structures.

The prior art impact type screwing machine adopts a hammering system. In the above example, the hammer cam 2*k* strikes the impact face 6*u* of the output shaft 6 to intermittently rotate the output shaft 6. Therefore, great vibrations and noises are generated due to rebounding of the hammer cam 2*k*.

SUMMARY OF THE INVENTION

An object of the invention is to provide a rotational actuator which makes direct use of expanding and contracting motions of an element to generate impact-wise torque, thus reducing energy loss, permitting great torque to be obtained and reducing vibrations, noises and reaction forces.

According to an aspect of the invention, a rotational actuator comprises:

an actuator case;

a first rotor supported on the actuator case for rotation about an axis of rotation;

a second rotor supported on the actuator case coaxially with the first rotor and for rotation independent of the first rotor;

an expandable member having one end secured to the second rotor and the other end secured to the first rotor for relatively rotating the first and second rotors by expansion or contraction thereof; and an expandable member controller for controlling the extent of expansion and contraction of the expandable member;

the momentum of the first rotor in the rotational direction thereof when the expandable member is expanded or contracted being set to be higher than the momentum of the second rotor in the rotational direction thereof at this time.

According to this aspect of the invention, the first rotor is coupled to the second rotor via the expandable member, and the momentum of the first rotor in the rotational direction thereof when the expandable member is expanded or contracted is set to be higher than the momentum of the second rotor in the rotational direction thereof at this time. The second rotor thus can be pulled to the first rotor without moving the first rotor by contracting the expandable member slowly by the expandable member controller. By stopping the contraction of the expandable member which has been contracted, an action similar to that obtained when the second rotor strikes the first rotor can be obtained. By this action, the first rotor is rotated slightly in the same direction as the second rotor. By suddenly expanding the expandable member from this state, the first rotor is further rotated. The second rotor, meanwhile, is rebounded to be rotated in the reverse direction. However, since the momentum of the first rotor in the rotational direction thereof is higher, the second rotor receives a force tending to be rotated in the same direction as the first rotor, so that the reverse rotation is blocked. Thus, the slow contraction of the expandable member can cause rotation of the second rotor and the subsequent quick expansion thereof can cause rotation of the first rotor in the same direction.

By repeating slow contraction and quick expansion of the expandable member by the expandable member controller, the first and second rotors can be rotated intermittently in a fixed direction with respect to the actuator case.

Conversely, by repeating slow expansion and quick contraction of the expandable member, the first and second rotors can be intermittently rotated in the reverse direction.

Since the expansion and contraction of the expandable member have a direct effect to cause intermittent rotation of the first and second rotors, there is substantially no energy loss, and also great torque can be obtained. Moreover, since the first and second rotors are coupled together by the expandable member, there exists substantially no portion subject to collision, and it is possible to reduce vibrations and noises.

According to a second aspect of the invention, a lock mechanism is provided, which can lock either the first rotor or the second rotor against rotation relative to the actuator case while the expandable member is expanded or contracted.

Thus, when the first rotor is locked by the lock mechanism when the expandable member is slowly contracted, the second rotor can be pulled to the first rotor irrespective of which of the momentums of the two rotors is higher. By stopping the contraction of the expandable member and releasing the lock of the first rotor when the expandable member has been contracted, an action similar to that obtained when the second rotor strikes the first rotor can be obtained, and the first rotor is rotated slightly in the same direction as the second rotor. By causing sudden expansion of the expandable member in this state, the first rotor is further rotated, and the second rotor is rotated in unison with the first rotor in the same direction. Thus, by repeatedly causing the locking of the first rotor when slowly contracting the expandable member and sudden expansion of the expandable member in the unlocked state of the first rotor, the first and second rotors can be rotated intermittently in a predetermined direction.

Also, by repeatedly causing the locking of the first rotor when slowly expanding the expandable member and quick contraction thereof in the unlocked state of the first rotor, the first and second rotors can be rotated intermittently in the reverse direction.

Similar results can be obtained by locking the second rotor instead of the first rotor. This means that a change in the momentum of the first rotor or the second rotor during rotation thereof has no substantial influence.

As the expandable member, a piezoelectric element is suitably used. The piezoelectric element has high output energy density, so that high output can be obtained with small-size and light-weight design and also with low power consumption. Moreover, the speed and extent of the expansion and contraction of the expandable member can be controlled according to the voltage applied thereto, thus facilitating the control of the expandable member and permitting simplification of the construction of the expandable member controller. It is thus possible to reduce the running cost and manufacturing cost of the rotational actuator.

Preferably, the rotational shaft of the first rotor or the second rotor has a radial extension, which is clamped by the lock mechanism with an action of the piezoelectric element.

In this case, high locking force can be obtained with low force of the piezoelectric element. In addition, the expansion or contraction of the expandable member and the operation of the lock mechanism can be readily synchronized, and it is possible to cope with the case of high frequency vibrations of the expandable element. Furthermore, size reduction of the rotational actuator is obtainable since it is possible to reduce the size and weight of the lock mechanism.

The present invention will be more fully understood from the following description and appended claims when taken with the accompanying drawings.

DETAILED DESCRIPTION OF THE PREFERRED EMBODIMENTS

First Embodiment

Figure 1:
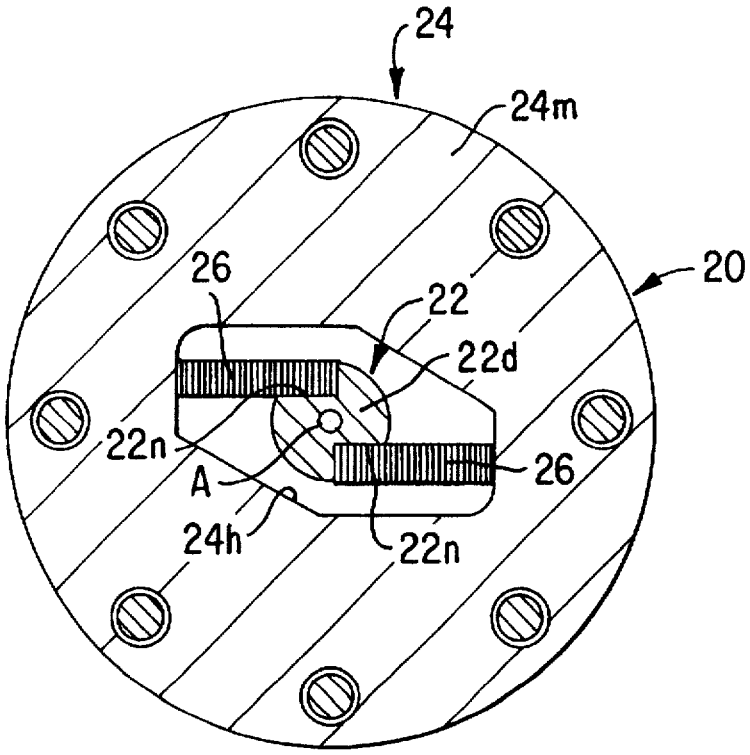
FIG. 1 is a sectional view showing a rotational actuator for screwing according to a first embodiment of the invention.

A rotational actuator according to a first embodiment of the invention and a rotational actuator for screwing using the same will now be described with reference to FIGS. 1, 2 and 3(A) to 3(D). FIG. 1 is a plan view showing a rotational actuator for screwing, and FIG. 2 is a side view, partly in section, showing the rotational actuator for screwing.

Figure 2:
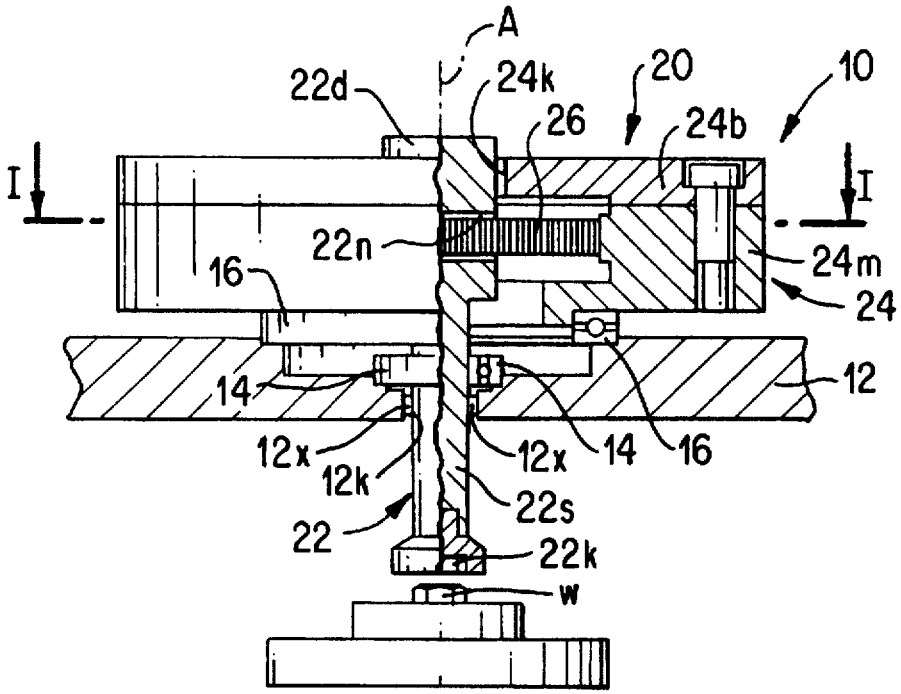
FIG. 2 is a side view, partly in section, showing the rotational actuator for screwing according to the first embodiment of the invention.

As shown in FIG. 2, a screwing rotational actuator 10 has a case 12 having a hole **12*k*, through which a shaft 22 of a rotational actuator 20 is inserted. On the hole 12*k* of the case 12, a radial bearing 14 is secured coaxially with the hole 12*k* and radially supports the shaft 22** for rotation.

Figure 2A:
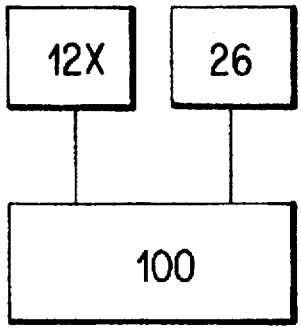
FIG. 2(A) is a block diagram showing the controller of the first embodiment of the invention.

A clamp **12*x* comprised of a piezoelectric element is mounted on the wall surface of the hole 12*k*. The thickness of the clamp 12*x* can be varied by controlling voltage applied to the piezoelectric element. The frictional force between the shaft 22 and the case 12 thus can be varied to lock and unlock the shaft 22 relative to the case 12. The shaft 22 can be locked to the case 12 at a predetermined timing according to a control signal inputted from a controller 100 to the piezoelectric element 12*x* (FIG. 2A). The clamp 12*x* and the controller 100** function together as a lock mechanism according to the invention.

The shaft 22 has a large diameter upper portion and a small diameter lower portion and is made of a highly rigid material. The small diameter portion of the shaft 22 (hereinafter referred to as small diameter shaft portion **22*s*) is supported by the radial bearing 14 for rotation relative to the case 12. A bolt head socket 22*k* which can be fitted on the head of a bolt w, is secured to the end (i.e., the lower end) of the small diameter shaft portion 22*s*. The upper large diameter portion (hereinafter referred to as large diameter shaft portion 22*d*), as shown in FIG. 1, has two side grooves 22*n* formed tangentially and in point symmetry with respect to its axis. Two expandable members 26 are secured to the large diameter shaft portion 22*d* such that each has an end portion received in each of the grooves 22*n*. The two expandable members 26 are connected tangentially to the large diameter shaft portion 22*d* such that they are arranged substantially in a Z-shaped configuration in plan. In other words, the expandable members 26 are secured tangentially to an outer surface of the shaft (the large diameter shaft portion 22*d*). A substantially ring-like rotational disc 24 is disposed around the large diameter portion 22*d* of the shaft 22. The rotational disc 24 has a body member 24*m* and a cover member 24*b* and is supported by a thrust bearing 16 secured to the case 12 coaxially with the shaft 22 and for rotation independent of the shaft 22**.

The body member **24*m* is made of a highly rigid material and has a central space 24*h* in which the large diameter shaft portion 22*d* of the shaft 22 and the two expandable members 26 secured to the large diameter shaft portion 22*d* are accommodated. As shown in FIG. 1, the space 24*h* is of substantially parallelogrammic shape in plan, and the other ends of the expandable members 26 are secured to the wall surfaces defining the space 24*h* which are perpendicular to the expandable members 26. In other words, the expandable members are secured to an inner surface of the body member 24*m***.

With the above construction that the large diameter shaft portion **22*d* of the shaft 22 and the body member 24*m* of the rotational disc 24 are connected to each other by the two expandable members 26 in point symmetry with respect to the axis A as shown in FIG. 1, expansion of the two expandable members 26 causes rotation of the shaft 22 in the clockwise direction as viewed in the drawing relative to the body member 24*m*. Contraction of the expandable members 26, on the other hand, causes counterclockwise rotation of the shaft 22 relative to the body member 24*m***.

The expandable members 26 are formed of piezoelectric elements laminated in their longitudinal direction and can be expanded or contracted in the longitudinal direction according to the voltage applied thereto. As in the case of the clamp 12*x*, a voltage signal is supplied from the controller 100 to the piezoelectric elements (FIG. 2A). The controller 100 serves as expandable member control means according to the invention.

Since the shaft 22 and the body member 24*m* of the rotational disc 24 are made of high rigidity material, the expanding and contracting motions of the expandable members 26 are not absorbed between the two parts 22 and 24*m*. To reinforce the rigidity of the body member 24*m*, a cover 24*b* made of a higher rigid material is fitted on and firmly screwed to the body member 24*m*. The cover 24*b* has a central hole 24*k*, through which the end of the large diameter shaft portion 22*d* of the shaft 22 can project.

The shaft 22 serves as a first rotor according to the invention, and the rotational disc 24 serves as a second rotor according to the invention. In a state that the bolt head socket 22*k* of the shaft 22 is fitted on the head of bolt w, the momentum of the shaft 22 serving as the first rotor in the rotational direction is higher than the momentum of the rotational disc 24 serving as the second rotor in the rotational direction.

The operation of the rotational actuator 20 according to this embodiment and the rotational actuator 10 for screwing utilizing the same will now be described with reference to FIG. 3.

First, the bolt head socket 22*k* of the shaft 22 is fitted on the head of bolt w to be screwed. The momentum of the shaft 22 in the rotational direction is thus made to be higher than the momentum of the rotational disc 24 in the rotational direction.

Figures 3A, 3B, 3C, 3D:
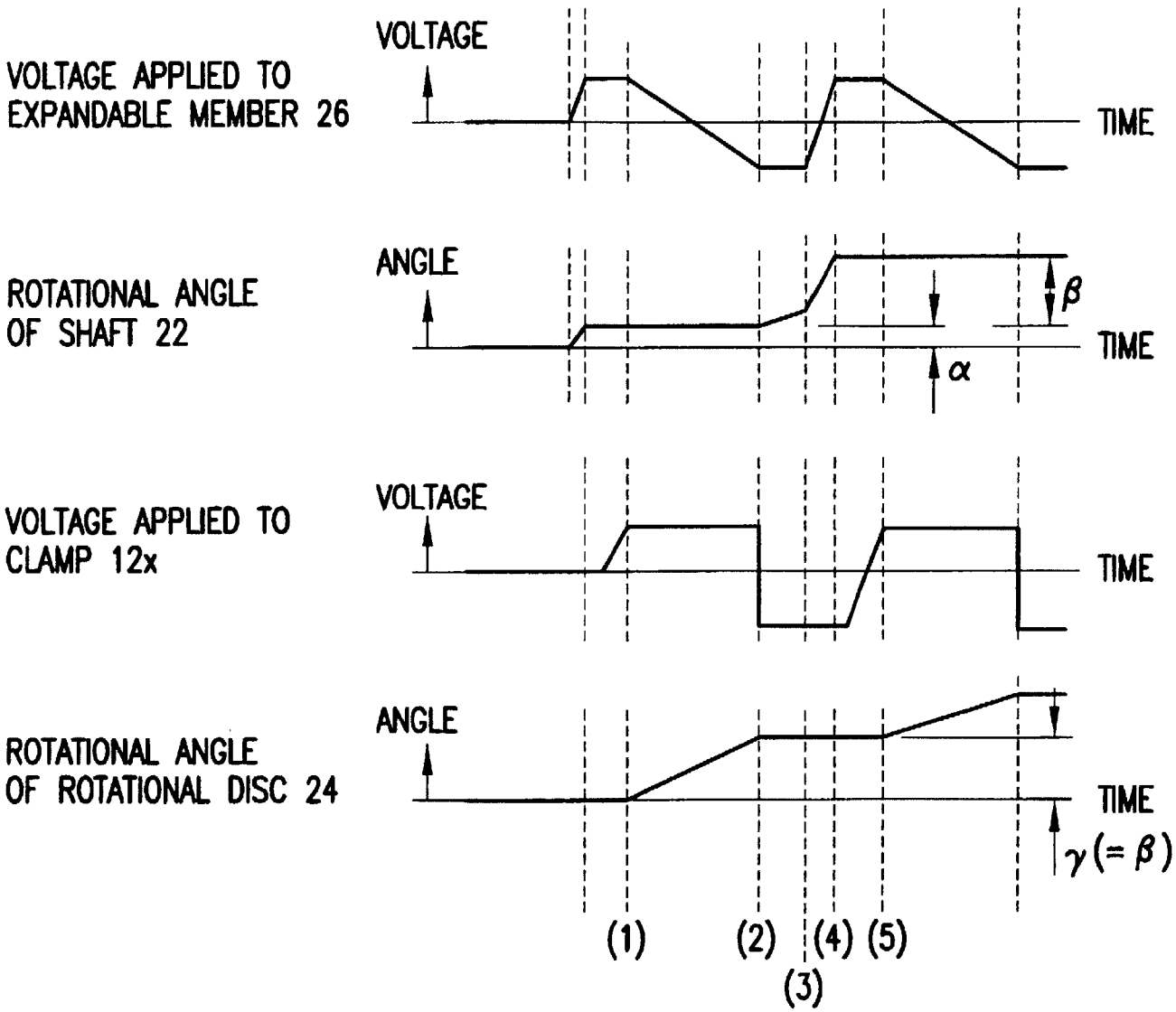
FIGS. 3(A) to 3(D) are graphs illustrating the operation of the rotational actuator for screwing according to the first embodiment of the invention.

In this state, a maximum voltage has been applied to the piezoelectric elements of the expandable members 26 as shown at timing (1) in FIG. 3(A), and the expandable members 26 are held in the most expanded state. The angle of the shaft 22 to the case 12 at this time is shown as $\alpha$. At this time, a maximum voltage is applied to the clamp 12*x* as shown in FIG. 3(C), and the shaft 22 is thus locked to the case 12. The rotational position of the rotational disc 24 at this time, is shown as reference position (zero angle position) in FIG. 3(D).

Then, the voltage applied to the piezoelectric elements of the expandable members 26 is reduced gradually at a predetermined rate, so that the expandable members 26 are contracted slowly at a predetermined rate. Since the shaft 22 is held locked to the case 12 at this time, the contraction of the expandable members 26 causes the rotational disc 24 to be pulled to the shaft 22 and be rotated in the clockwise direction as viewed in FIG. 1. Since the momentum of the shaft 22 in the rotational direction, with the bolt head socket 22*k* fitted on the head of the bolt w, is higher than the momentum of the rotational disc 24 in the rotational direction, the rotational disc 24 is pulled to the shaft 22 and rotated clockwise in FIG. 1 at this time even when the shaft 22 is not locked to the case 12.

When the expandable members 26 are contracted to the utmost, i.e., at timing (2), the voltage applied to the piezoelectric elements of the expandable member 26 is held constant, and the voltage applied to the clamp 12*x* is reduced to a minimum to cause unlocking of the shaft 22. As a result, the expandable members 26 are held in the most contracted state, and the shaft 22 is able to be rotated relative to the case 12. When the contracting action of the expandable members 26 being performed at the predetermined rate is suddenly stopped (i.e. at timing (2)), a similar action to that produced when the rotational disc 24 tangentially strikes the shaft 22 is obtained, that is, the shaft 22 is moved slightly in the clockwise direction in FIG. 1 like the rotational disc 24. As the expandable members 26 undergo a change in state from the most expanded state (timing (1)) to the most contracted state (timing (2)), the rotational disc 24 is rotated clockwise by angle $\gamma$ from the reference position.

Subsequently (at timing (3)), a quickly rising voltage is applied to the piezoelectric elements of the expandable members 26 to cause quick expansion thereof. At this time, the shaft 22 has started its rotation in the clockwise direction in FIG. 1 as described before, and it is thus rotated clockwise with the quick expansion of the expandable members 26. The rotational disc 24, on the other hand, is rebounded to be reversely rotated. However, since the momentum of the shaft 22 in the rotational direction thereof is higher, the reverse rotation of the rotational disc 24 is prevented by a force tending to rotate the rotational disc 24 in the same direction as the shaft 22. Rather, the rotational disc 24 is rotated in the same direction as the shaft 22. When the expandable members 26 are expanded utmost, i.e., at timing (4), the voltage applied to the piezoelectric elements of the expandable members 26 is held constant, and the shaft 22 is rotated clockwise by angle $\beta$ from its position of angle $\alpha$ at timing (3), thus screwing the bolt w. The angle $\gamma$ of rotation of the rotational disc 24 and the angle $\beta$ of rotation of the shaft 22 are eventually made equal. When the shaft 22 is thus rotated by angle $\beta$, a quickly rising voltage is applied to the clamp 12*x* to lock the shaft 22 to the case 12. This state is shown at timing (5). At this time, the position relation between the shaft 22 and the rotational disc 24, is brought back to that at timing (1). In other words, timings (1) and (5) are equivalent. This means that one cycle is constituted from timings (1) to (5).

With repeated execution of the operation from timings (1) to (5), the rotational disc 24 and the shaft 22 are rotated alternately by a predetermined angle ($\gamma=\beta$) in the clockwise direction to screw the bolt w.

During a period of time from timing (1) to timing (2), the expandable members 26 are slowly contracted to pull the rotational disc 24 to the shaft 22 with the shaft 22 held locked to the case 12 by the clamp 12*x*. Even when the shaft 22 is not locked to the case 12, however, the rotational disc 24 can be pulled to the shaft 22 so long as the bolt head socket 22*k* is reliably fitted on the head of the bolt w because in this case the momentum of the shaft 22 in the rotational direction thereof is higher than the momentum of the rotational disc 24 in the rotational direction thereof. Theoretically, it is thus possible, without the clamp 12*x*, to rotate the shaft 22 and the rotational disc 24 by expanding and contracting the expandable members 26. In this embodiment, however, the clamp 12*x* is provided to permit reliable driving of the rotational actuator 20 even when the bolt head socket 22*k* is not fitted on the head of the bolt w or in the event of failure of close contact between the bolt head socket 22*k* and the bolt w.

It is also possible to cause converse rotation of the shaft 22 and the rotational disc 24 in the counterclockwise direction by causing slow expansion and quick contraction of the expandable members 26. Thus, the shaft 22 and the rotational disc 24 can be rotated directly by causing expansion and contraction of the expandable members 26. Thus, there is substantially no energy loss, and high output torque can be obtained. Besides, since the shaft 22 and the rotational disc 24 are connected to each other via the expandable members 26, there actually exists no part subject to collision, and it is possible to reduce vibrations and noises.

With the provision of the clamp 12*x* which locks the shaft 22 against rotation relative to the case 12 while the expandable members 26 are expanded or contracted, the rotational actuator 20 can be driven even when the bolt head socket 22*k* of the shaft 22 is not fitted on the head of the bolt w, that is, when the momentum of the shaft 22 in the rotational direction is lower than the momentum of the rotational disc 24 in the rotational direction. The rotational actuator 20 also can be driven satisfactorily even when the engagement between the bolt head socket 22*k* and the head of the bolt w are loosened.

Since the clamp 12*x* can lock the shaft 22 to the case 12 by the action of the piezoelectric elements, the expanding/contracting operation of the expandable members 26 and the locking operation by the clamp 12*x* can be readily synchronized to each other. It is thus possible to cope with the case in which the expandable members 26 are vibrated at high frequency . The size of the rotational actuator 20 can be reduced since it is possible to reduce the size and weight of the clamp 12*x*.

The shaft 22 of the rotational actuator and the rotational disc 24 are rotatably supported on the case 12 of the actuator 10 for screwing via the radial bearing 14 and the thrust bearing 16. Thus, the reaction force of screwing is not directly exerted to the case 12 although it is exerted to the shaft 22 and the rotational disc 24, so that the operational burden of an operator of the screwing actuator 10 is reduced.

Since the expandable members 26 can be expanded and contracted by the action of the piezoelectric elements, high output can be obtained with a small-size light-weight structure, and power consumption is low. Since the rate and extent of the expansion and contraction of the expandable members 26 can be controlled with voltage, the expandable members 26 can be readily controlled, and the construction of the expandable member controller 100 can be simplified. It is thus possible to reduce the running cost and manufacturing cost of the rotational actuator.

While in this embodiment, the expandable members 26 are fabricated by using piezoelectric elements, this is by no means limitative; for example, it is possible to use magnetostriction elements or the like.

Second Embodiment

Figure 4:
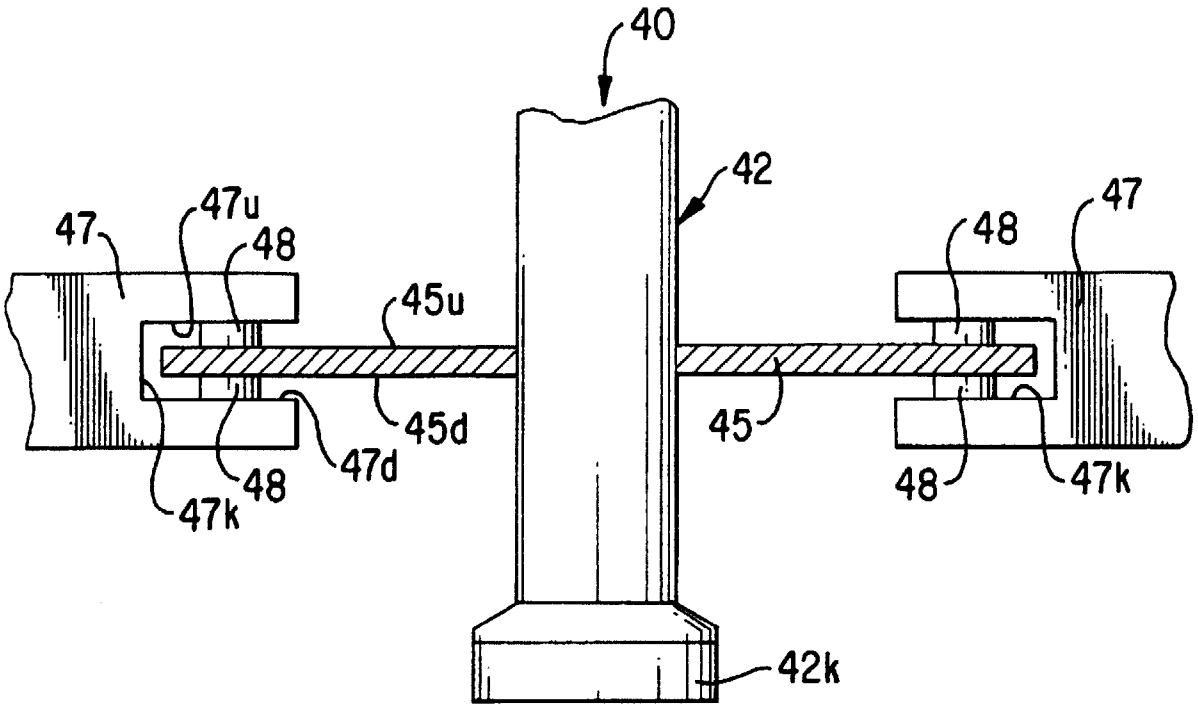
FIG. 4 is a fragmentary side view showing a rotational actuator for screwing according to a second embodiment of the invention.
Figure 5A:
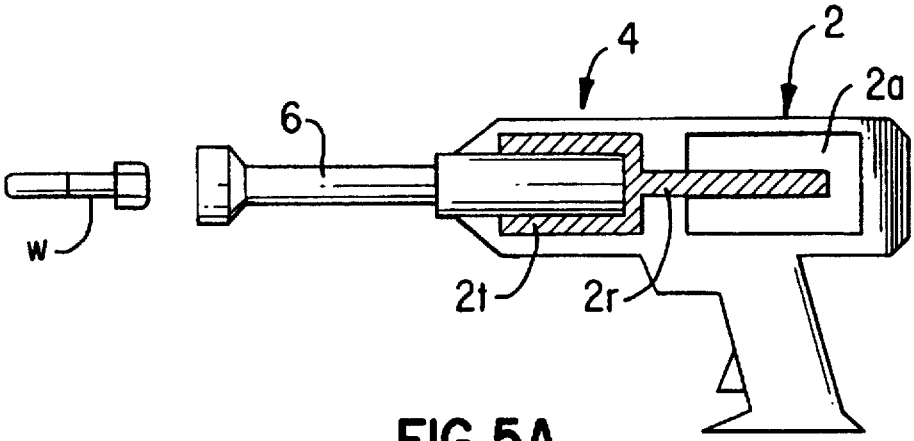
FIG. 5A PRIOR ART
FIGS. 5(A) to 5(C) are a side view and fragmentary sectional views showing a prior art screwing machine.
Figure 5B:
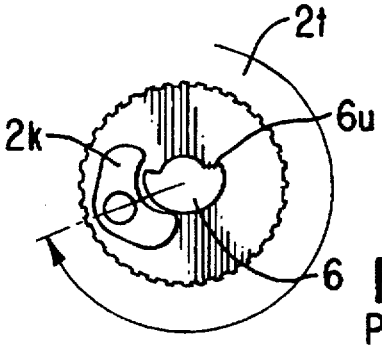
FIG. 5B PRIOR ART
Figure 5C:
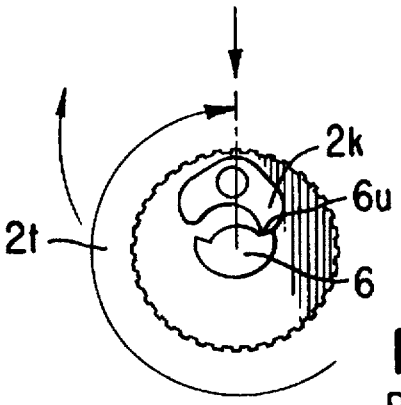
FIG. 5C PRIOR ART

Now, an actuator 40 for screwing according to a second embodiment of the invention will be described with reference to FIG. 4.

This rotational actuator 40 for screwing is an improvement of the lock mechanism (i.e., clamp 12*x*, etc.) of the rotational actuator 10 for screwing described before in connection with the first embodiment. The construction is otherwise the same as that of the actuator 10 for screwing.

A flange-like disc 45 is secured horizontally to a shaft 42 of the rotational actuator 40 for screwing near the end of the shaft 42. The shaft 42 has a working end 42*k*.

Disc supports 47 are disposed on horizontally opposite sides of the shaft 42. The disc supports 47 are secured to a case (not shown) of the actuator 40 for screwing. Each disc support 47 has its end formed with a recess 47*k* in which the edge of the disc 45 of the shaft 42 is received. Pads 48 formed by piezoelectric elements are secured to upper and lower surfaces 47*u* and 47*d* of the recess 47*k* for contacting upper and lower surfaces 45*u* and 45*d* of the disc 45. The disc 45 of the shaft 42 thus can be clamped to be locked to the disc supports 47 of the case and unclamped to be unlocked with expansion and contraction of the pads 48. A voltage signal is inputted to the piezoelectric elements of the pads 48 from a controller (not shown) to lock the shaft 42 to the case at a predetermined timing.

The disc 45 of the shaft 42, disc supports 47, pads 48, etc., constitute the lock mechanism according to the invention. The disc 45 corresponds to the radial extension according to the invention.

In this embodiment, the shaft 42 is locked to the case by clamping the disc 45 from the front and back sides thereof. It is thus possible to obtain high locking force even with low forces provided by the piezoelectric elements.

Further, in the above embodiments, the rotational disc may be locked to the case. In this case as well, the rotational disc and the shaft can be rotated in the same direction.

According to the invention, the expansion and contraction of the expandable members have an effect of directly causing rotation of the first and second rotors. Thus, there is substantially no energy loss, and high torque can be obtained. Moreover, since the first and second rotors are connected to each other by the expandable members, actually there exists no part subject to collision, and it is possible to reduce vibrations and noises.

While the invention has been described with reference to preferred embodiments thereof, it is to be understood that modifications or variations may be easily made without departing from the scope of the present invention which is defined by the appended claims.

What is claimed is:

1. A rotational actuator for generating intermittent rotations, comprising:

an actuator case;

a first rotor supported on the actuator case for rotation about an axis of rotation;

a second rotor supported on the actuator case coaxially with the first rotor;

an expandable member having one end secured to the second rotor and the other end secured to the first rotor for relatively rotating the first and second rotors by expansion or contraction thereof, and expandable member control means for controlling the timing and extent of expansion and contraction of the expandable member to coordinate relative rotation of the first and second rotors;

wherein the momentum of the first rotor in the rotational direction thereof is greater than the momentum of the second rotor in the rotational direction thereof when the expandable member is expanded or contracted.

2. A rotational actuator for generating intermittent rotations, comprising:

an actuator case;

a first rotor supported on the actuator case for rotation about an axis of rotation;

a second rotor supported on the actuator case coaxially with the first rotor;

an expandable member having one end secured to the second rotor and the other end secured to the first rotor for relatively rotating the first and second rotors by expansion or contraction thereof;

expandable member control means for controlling the timing and extent of expansion and contraction of the expandable member to coordinate relative rotation of the first and second rotors; and a lock mechanism for locking the first rotor against rotation relative to the actuator case when the expandable member is expanded or contracted.

3. The rotational actuator according to claim 1, wherein the first rotor has a screw head socket.

4. The rotational actuator according to claim 2, wherein the first rotor has a screw head socket.

5. The rotational actuator according to claim 1, wherein the expandable member is expanded or contracted by the action of a piezoelectric element.

6. The rotational actuator according to claim 2, wherein the expandable member is expanded or contracted by the action of a piezoelectric element.

7. The rotational actuator according to claim 2, wherein the first rotor includes a rotational shaft having a radial extension, the radial extension being lockable by activation of the lock mechanism.

8. The rotational actuator according to claim 1, wherein the second rotor is supported for rotation around the first rotor, and wherein the expandable member has one end secured to an inner surface of the second rotor and the other end tangentially secured to an outer surface of the first rotor.

9. The rotational actuator according to claim 2, wherein the second rotor is supported for rotation around the first rotor, and wherein the expandable member has one end secured to an inner surface of the second rotor and the other end tangentially secured to an outer surface of the first rotor.

10. The rotational actuator according to claim 7, wherein the lock mechanism includes a disc coupled to the first rotor and a mechanism for clamping the disc from front and rear sides thereof with a force of the piezoelectric element.

11. The rotational actuator according to claim 1, wherein the expandable member control means expands the expandable member at high speed and contracts the expandable number at low speed.

12. The rotational actuator according to claim 1, wherein the expandable member control means expands the expandable member at low speed and contracts the expandable member same at high speed.

13. The rotational actuator according to claim 2, wherein the expandable member control means expands the expandable member at high speed and contracts the expandable member at low speed.

14. The rotational actuator according to claim 2, wherein the expandable member control means expands the expandable member at low speed and contracts the expandable member at high speed.

* * * * *